US007712154B1

(12) United States Patent
Adams-Zarrella

(10) Patent No.: US 7,712,154 B1
(45) Date of Patent: May 11, 2010

(54) CHEEKERS

(76) Inventor: Linda E. Adams-Zarrella, 5242 E. Cerritos Dr., Orange, CA (US) 92869

( * ) Notice: Subject to any disclaimer, the term of this patent is extended or adjusted under 35 U.S.C. 154(b) by 758 days.

(21) Appl. No.: 11/110,456

(22) Filed: Apr. 21, 2005

Related U.S. Application Data

(60) Provisional application No. 60/568,249, filed on May 6, 2004.

(51) Int. Cl.
*A41D 27/20* (2006.01)
*A41D 13/02* (2006.01)
*A41D 1/06* (2006.01)

(52) U.S. Cl. ..... 2/247; 2/227

(58) Field of Classification Search ..... 2/227, 2/238, 239, 247, 255, 272
See application file for complete search history.

(56) References Cited

U.S. PATENT DOCUMENTS 1,191,275 A * 7/1916 Brehl ..... 2/247
2,589,409 A * 3/1952 Leichter ..... 40/586
2,671,902 A * 3/1954 Grue ..... 40/586
3,828,368 A 8/1974 Lam
4,446,573 A * 5/1984 Green ..... 2/252
4,501,024 A 2/1985 Russo
5,794,267 A * 8/1998 Wallace ..... 2/227
5,832,540 A * 11/1998 Knight ..... 2/247
5,970,516 A 10/1999 Shimooka
6,473,908 B1 * 11/2002 Bontems ..... 2/227

OTHER PUBLICATIONS

"lining"; WordNet Search-2.1; http://wordnet.princeton.edu/perl/webwn; page 1.*

* cited by examiner

*Primary Examiner*—Gary L Welch
*Assistant Examiner*—Amber R Anderson
(74) *Attorney, Agent, or Firm*—Patent & Trademark Services, Inc.; Joseph H. McGlynn

(57) ABSTRACT

A wearing apparel made from fabric, and having a outside surface and an inside surface. The outside surface being the surface remote from a user wearing the wearing apparel. The wearing apparel having a front and a back, and the back of the wearing apparel having at least one pocket attached thereto. The pocket having an inside surface and an outside surface, with an aperture extending from the outside surface through to the inside surface of the pocket. A second aperture extends from the outside surface of the fabric through to the inside surface of the fabric, and a portion of the inside surface of the fabric blocks the second aperture.

14 Claims, 1 Drawing Sheet

CHEEKERS

Applicant claims priority of Provisional application 60/568,249, filed May 6, 2004.

BACKGROUND OF THE INVENTION

This invention relates, in general, to wearing apparel, and, in particular, to wearing apparel having cutouts on the rear pockets.

DESCRIPTION OF THE PRIOR ART

In the prior art various types of devices have been proposed. For example, U.S. Pat. No. 3,828,368 to Lam discloses wearing apparel with cut outs in the rear that allow a wearer's skin to show through.

U.S. Pat. No. 4,501,024 to Russo discloses a swim suit with cut outs in the rear that allow a wearer's skin to show through.

U.S. Pat. No. 6,473,908 to Bontems discloses a garment having a buttocks covering portion and a buttocks cleavage reveling portion.

U.S. Pat. No. 5,970,516 to Shimooka discloses a swim suit with a light blocking pattern and a light transmitting pattern.

SUMMARY OF THE INVENTION

The present invention is directed to wearing apparel having rear pockets, and the pockets have cutouts in a variety of shapes. The cutouts extend through the pocket and through the material inside the pocket area. A material such as sheer lace or tulle can be placed adjacent the wearer's exposed skin.

It is an object of the present invention to provide a new and improved wearing apparel.

It is an object of the present invention to provide a new and improved wearing apparel with cutouts to commemorate different holidays.

These and other objects and advantages of the present invention will be fully apparent from the following description, when taken in connection with the annexed drawings.

DESCRIPTION OF THE PREFERRED EMBODIMENT

Figure 1:
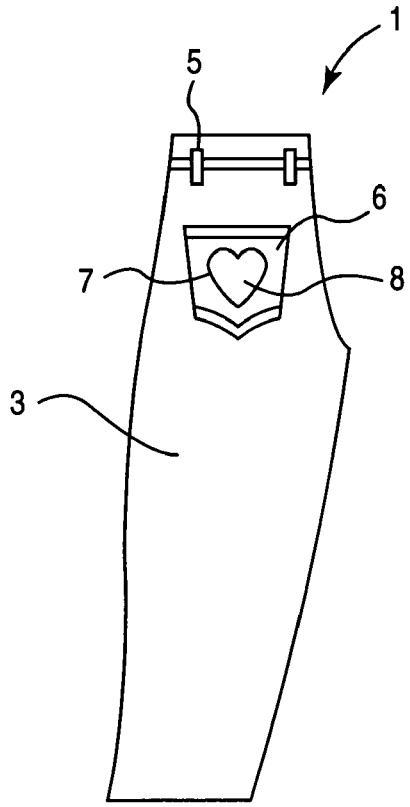
FIG. 1 is a partial view of one of the legs of a pair of pants showing the present invention.
Figure 2:
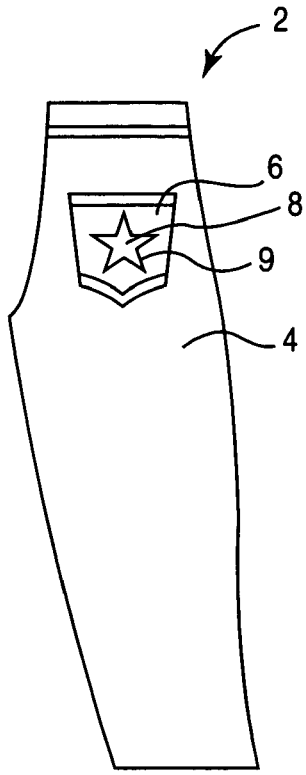
FIG. 2 is a partial view of one of the legs of a another pair of pants showing the present invention.

Referring now to the drawings in greater detail, FIGS. 1 and 2 show two different pair of pants 1 and 2 embodying the present invention. It should be noted that the wearing apparel used with the present invention could be for men, women or children. The wearing apparel could be pants, as shown in FIGS. 1 and 2 or the apparel could be jeans, slacks, shorts or any other kind of clothing of this type.

As shown in FIG. 1 the pair of pants 1 has a lower portion 3 and a belt loop 5 which is conventional and which will accept a belt or the like. Below the belt loops 5 is a rear pocket 6 attached to the pants in any conventional manner. It should be noted that only one of the pockets for each pair of pants is shown in FIGS. 1 and 2 since both pockets will generally be the same. However, if desired one of the pockets could have a first design and the other rear pocket on the same pair of pants could have a second design. For example, the heart 7 could be on the left hand rear pocket and the star 9 could be on the right hand rear pocket. Also, the heart and the star are not the only designs which could be used with the present invention. Other designs such as, but not limited to lips, flowers, etc. could be used as well.

As shown in FIGS. 1 and 2 each pocket 6 has a portion cut out of the fabric which forms the pocket. The cut out portion can be in a variety of shapes such as, but not limited to hearts, stars, lips, flowers, etc. Each cutout will extend through the outer material that forms the pocket and through the inner material that forms the pocket. That is, the cutout will extend from the outermost part of the pocket through to the inside of the pants, where the inside of the pants is the part of the pants next to the wearer's skin.

Figure 3:
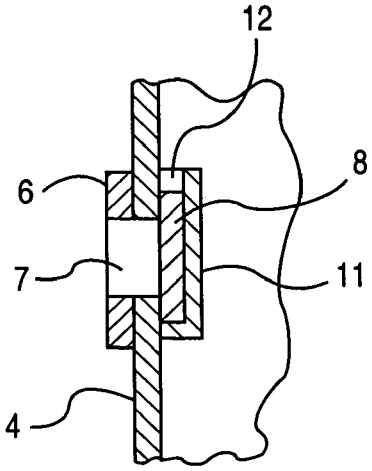
FIG. 3 is a partial cross-sectional view of the present invention.

FIG. 3 shows a cross-sectional view of the pocket and the inside area of the pants immediately adjacent the pocket. As shown the inside surface of the pocket is the outside surface of the pants. As shown the pocket 6 has a cutout 7. The cutout 7 extends through the pants 2 above the lower portion 4, and absent any other factors, the skin of a person wearing the pants would show through the cutout. A layer of material 8 is secured inside the pants 2 or pocket to block the cutout 7. The material 8 is preferably sheer lace which will provide a peek-a-boo effect to the pocket. The material 8 could be sewn to the inside of the pants or pocket to hold the material in position. Another way of securing the material 8 is to provide a second pocket 11 on the inside of the pants which has an open top 12. The material 8 could be passed through the open top 12 so it shows through the cutout 7. This would allow the user to change materials 8 as desired, or to have one type of material in the left hand pocket and a different material in the right hand pocket.

In addition, the material 8 could be treated with a compound, such as starch, to make the material stiff enough so it will not collapse into the bottom of the pocket 11 when the pants are worn. Also, instead of using a stiffening agent such as starch, the material 8 could be mounted to a material that is stiffer than the material 8 such as cardboard, leather, etc. This would allow the user to easily change the material 8.

Although the Cheekers and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A wearing apparel, said wearing apparel made from fabric, and said fabric having an outside surface and an inside surface, said outside surface being the surface remote from a user wearing said wearing apparel, said wearing apparel having a front and a back, said back of said wearing apparel having at least one pocket attached thereto, said at least one pocket having an inside surface and an outside surface, an aperture extending from said outside surface through to said inside surface of said pocket, a second aperture extending from said outside surface of said fabric through to said inside surface of said fabric, means secured to said inside surface of said fabric for blocking said second aperture, and wherein said means secured to said inside surface of said fabric for blocking said second aperture is lace in the pocket, and wherein said wearing apparel has means for securing said lace in position for blocking said second aperture, and wherein said means for securing said lace in position for blocking said second aperture is a second pocket.

2. The wearing apparel as claimed in claim 1, wherein said wearing apparel is jeans.

3. The wearing apparel as claimed in claim 1, wherein said aperture extending from said outside surface through to said inside surface of said pocket has a shape and said shape is a heart.

4. The wearing apparel as claimed in claim 1, wherein said aperture extending from said outside surface through to said inside surface of said pocket has a shape and said shape is a star.

5. The wearing apparel as claimed in claim 1, wherein said second pocket has an open top.

6. The wearing apparel as claimed in claim 1, wherein said means secured to said inside surface of said fabric for blocking said second aperture completely blocks said second aperture.

7. The wearing apparel as claimed in claim 1, wherein said first aperture is superimposed over said second aperture.

8. A wearing apparel, said wearing apparel having an outside surface and an inside surface, said outside surface being the surface remote from a user wearing said wearing apparel, said wearing apparel having at least one pocket attached thereto, said at least one pocket having an inside surface and an outside surface, an aperture extending from said outside surface through to said inside surface of said pocket, a second aperture extending from said outside surface of said wearing apparel through to said inside surface of said wearing apparel, blocking means secured to said inside surface of said wearing apparel for blocking said second aperture, and means for securing said blocking means in position for blocking said second aperture, and wherein said means for securing said blocking means in position for blocking said second aperture is a second pocket.

9. The wearing apparel as claimed in claim 8, wherein said second pocket has an open top.

10. The wearing apparel as claimed in claim 8, wherein said blocking means secured to said inside surface of said wearing apparel for blocking said second aperture completely blocks said second aperture.

11. The wearing apparel as claimed in claim 8, wherein said first aperture is superimposed over said second aperture.

12. A wearing apparel, said wearing apparel made from fabric, and said fabric having an outside surface and an inside surface, said outside surface being the surface remote from a user wearing said wearing apparel, and said inside surface being the surface directly adjacent a user wearing said wearing apparel, said wearing apparel having at least one pocket attached thereto, said at least one pocket having an inside surface and an outside surface, an aperture extending from said outside surface through to said inside surface of said pocket, said inside surface of said pocket being the outside surface of said wearing apparel, a second aperture extending from said outside surface of said fabric through said outside and inside surfaces of said fabric, means secured to said inside surface of said fabric for blocking said second aperture, and wherein said wearing apparel has means for securing said blocking means in position for blocking said second aperture, and wherein said means for securing said blocking means in position for blocking said second aperture is a second pocket.

13. The wearing apparel as claimed in claim 12, wherein said second pocket has an open top.

14. The wearing apparel as claimed in claim 12, wherein said means secured to said inside surface of said fabric for blocking said second aperture completely blocks said second aperture.

* * * * *